US007988139B2

(12) United States Patent
Matsuura

(10) Patent No.: US 7,988,139 B2
(45) Date of Patent: Aug. 2, 2011

(54) SHEET POST-PROCESSING DEVICE AND IMAGE FORMING APPARATUS

(75) Inventor: Hiromasa Matsuura, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 268 days.

(21) Appl. No.: 12/318,943

(22) Filed: Jan. 13, 2009

(65) Prior Publication Data

US 2009/0218746 A1 Sep. 3, 2009

(30) Foreign Application Priority Data

Feb. 28, 2008 (JP) ..... 2008-047104
Sep. 19, 2008 (JP) ..... 2008-240120

(51) Int. Cl.
*B65H 37/04* (2006.01)

(52) U.S. Cl. ..... 270/58.12; 270/58.07; 270/58.08; 270/58.09; 270/58.11; 270/58.17; 270/58.27

(58) Field of Classification Search ..... 270/58.07, 270/58.08, 58.09, 58.11, 58.12, 58.17, 58.27
See application file for complete search history.

(56) References Cited

U.S. PATENT DOCUMENTS 5,263,697 A * 11/1993 Yamazaki et al. ..... 270/58.08
5,639,078 A * 6/1997 Mandel et al. ..... 270/58.12
6,343,785 B1 * 2/2002 Yamada et al. ..... 270/58.08
6,698,744 B2 3/2004 Yamada et al.
6,832,759 B2 12/2004 Nagasako et al.
6,845,228 B2 * 1/2005 Suzuki et al. ..... 399/407
7,416,177 B2 8/2008 Suzuki et al.
7,597,312 B2 * 10/2009 Nishioka ..... 270/58.12
2007/0096381 A1 * 5/2007 Nishioka ..... 270/58.12
2008/0006993 A1 1/2008 Nomura et al.
2008/0211162 A1 9/2008 Suzuki et al.

FOREIGN PATENT DOCUMENTS

CN 1958418 A 5/2007
JP 2005-314092 11/2005

OTHER PUBLICATIONS

Office Action dated Dec. 31, 2010 for corresponding Chinese Patent Application No. 200910118080.

* cited by examiner

*Primary Examiner* — Leslie A Nicholson, III
(74) *Attorney, Agent, or Firm* — Harness, Dickey & Pierce, P.L.C.

(57) ABSTRACT

A reference member serves as a reference for aligning trailing edges of a stack of sheets stacked on a binding tray. A binding unit binds the sheets with the trailing edges aligned. A discharge unit discharges the sheets with or without performing the binding process from the binding tray to a discharge tray. The reference member is movable in a sheet width direction such that a first position of the reference member at a time of discharging the sheets without performing the binding process is closer to a center of the binding tray than a second position of the reference member at a time of discharging the sheets with performing the binding process.

19 Claims, 8 Drawing Sheets

SHEET POST-PROCESSING DEVICE AND IMAGE FORMING APPARATUS

CROSS-REFERENCE TO RELATED APPLICATIONS

The present application claims priority to and incorporates by reference the entire contents of Japanese priority document 2008-047104 filed in Japan on Feb. 28, 2008 and Japanese priority document 2008-240120 filed in Japan on Sep. 19, 2008.

BACKGROUND OF THE INVENTION

1. Field of the Invention

The present invention relates to a technology for post processing sheets for aligning, sorting, and binding the sheets.

2. Description of the Related Art

A sheet post-processing device is used for, for example, aligning, sorting, and binding sheets after forming images on the sheets in an image forming apparatus. Japanese Patent Application Laid-open No. 2005-314092 discloses a technology for aligning a trailing edge of a sheet using a pair of reference members and discharging an aligned stack of sheets with or without performing binding of the sheets. The reference members are located with a constant interval, receiving both sides of the trailing edge of a sheet.

However, the sides of the trailing edge of the sheet is easily curled compared to the center portion of the trailing edge of the sheet and the amount of curl is larger at the sides than at the center portion, so that a curled side of the trailing edge of the sheet may not be abutted with a reference plane, resulting in insufficient alignment of the sheet. If sheets are discharged without being bound as they are not aligned, the sheets are randomly stacked on a discharge tray, causing a difficulty in sorting sheets.

SUMMARY OF THE INVENTION

It is an object of the present invention to at least partially solve the problems in the conventional technology.

According to one aspect of the present invention, there is provided a sheet post-processing device that discharges a stack of sheets with trailing edges aligned with performing a binding process or without performing the binding process. The sheet post-processing device includes a binding tray on which the sheets are stacked; a reference member that serves as a reference for aligning the trailing edges of the sheets stacked on the binding tray; a binding unit that binds the sheets with the trailing edges aligned; a discharge tray to which the sheets are discharged; and a discharge unit that discharges the sheets with or without performing the binding process from the binding tray to the discharge tray. The reference member is movable in a sheet width direction such that a first position of the reference member at a time of discharging the sheets without performing the binding process is closer to a center of the binding tray than a second position of the reference member at a time of discharging the sheets with performing the binding process.

Furthermore, according to another aspect of the present invention, there is provided an image forming apparatus including a sheet post-processing device that discharges a stack of sheets with trailing edges aligned with performing a binding process or without performing the binding process, which includes a binding tray on which the sheets are stacked, a reference member that serves as a reference for aligning the trailing edges of the sheets stacked on the binding tray, a binding unit that binds the sheets with the trailing edges aligned, a discharge tray to which the sheets are discharged, and a discharge unit that discharges the sheets with or without performing the binding process from the binding tray to the discharge tray; a moving unit that moves the reference member in a sheet width direction; and a control unit that controls the moving unit. The control unit controls the moving unit to move the reference member, such that a first position of the reference member at a time of discharging the sheets without performing the binding process is closer to a center of the binding tray than a second position of the reference member at a time of discharging the sheets with performing the binding process.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
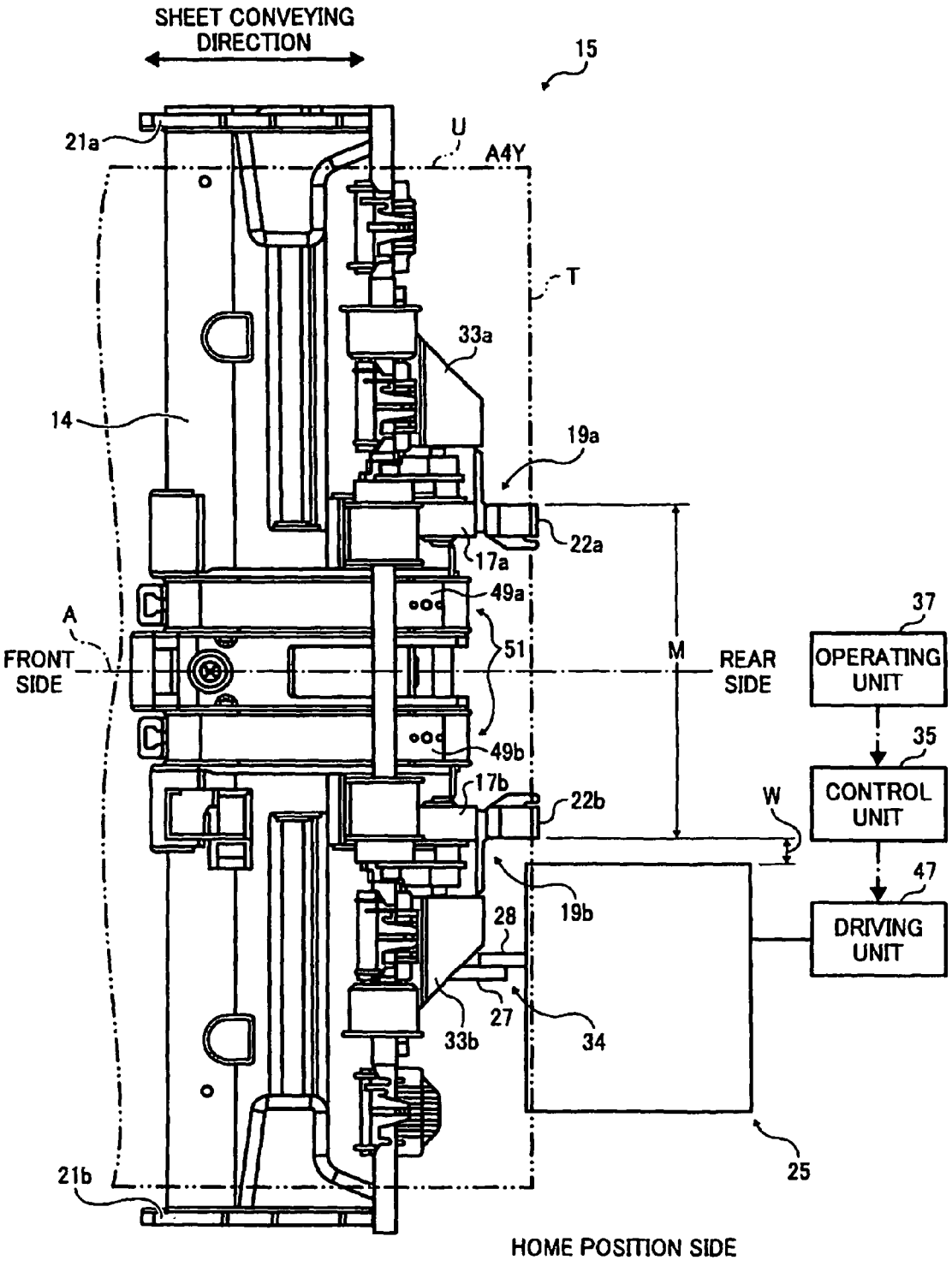
FIG. 1 is a plan view of a relevant portion of a staple tray of a sheet post-processing device in sorting mode according a first embodiment of the present invention.
Figure 2:
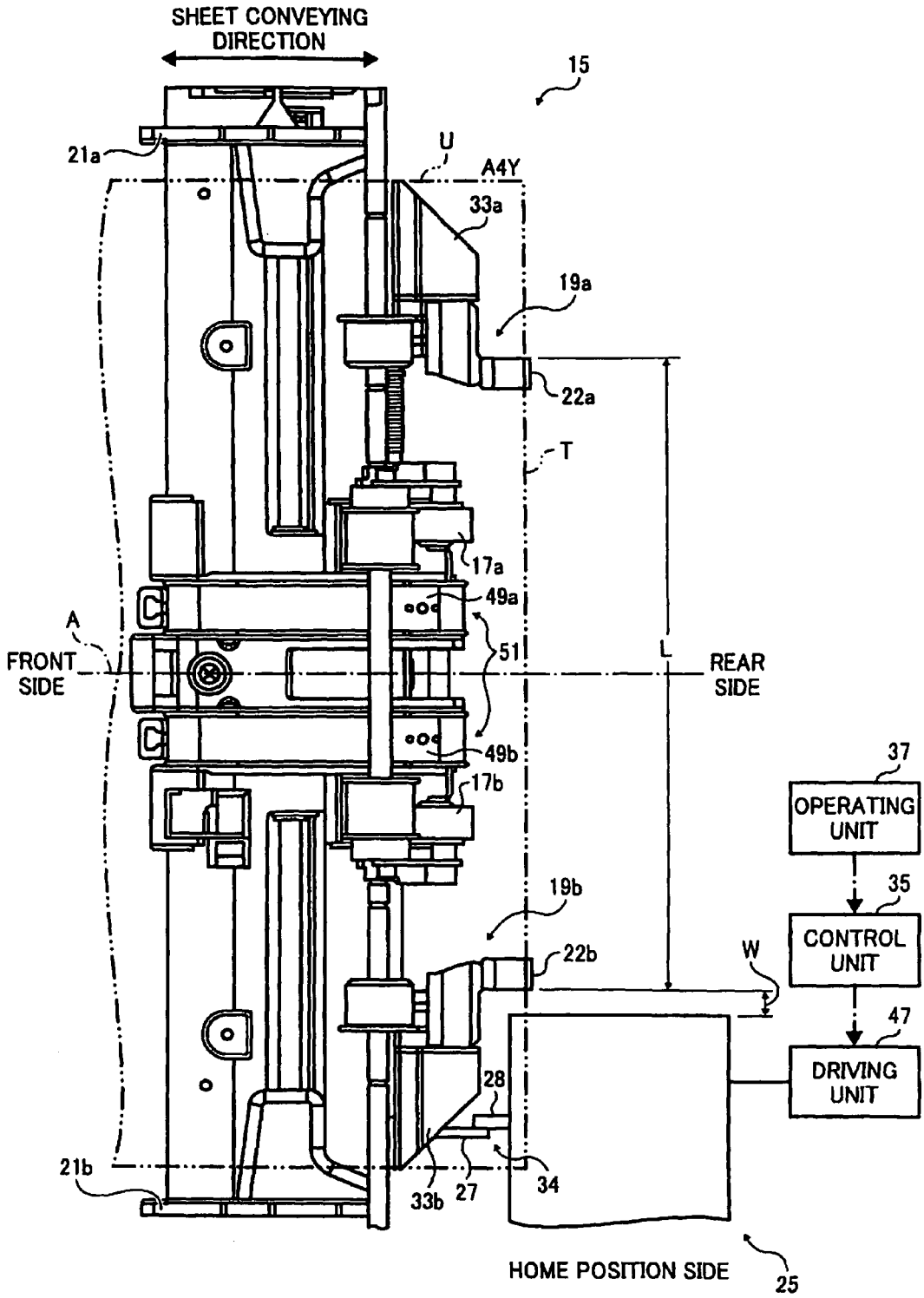
FIG. 2 is a plan view of the relevant portion of the staple tray of the sheet post-processing device in stapling mode.
Figure 3:
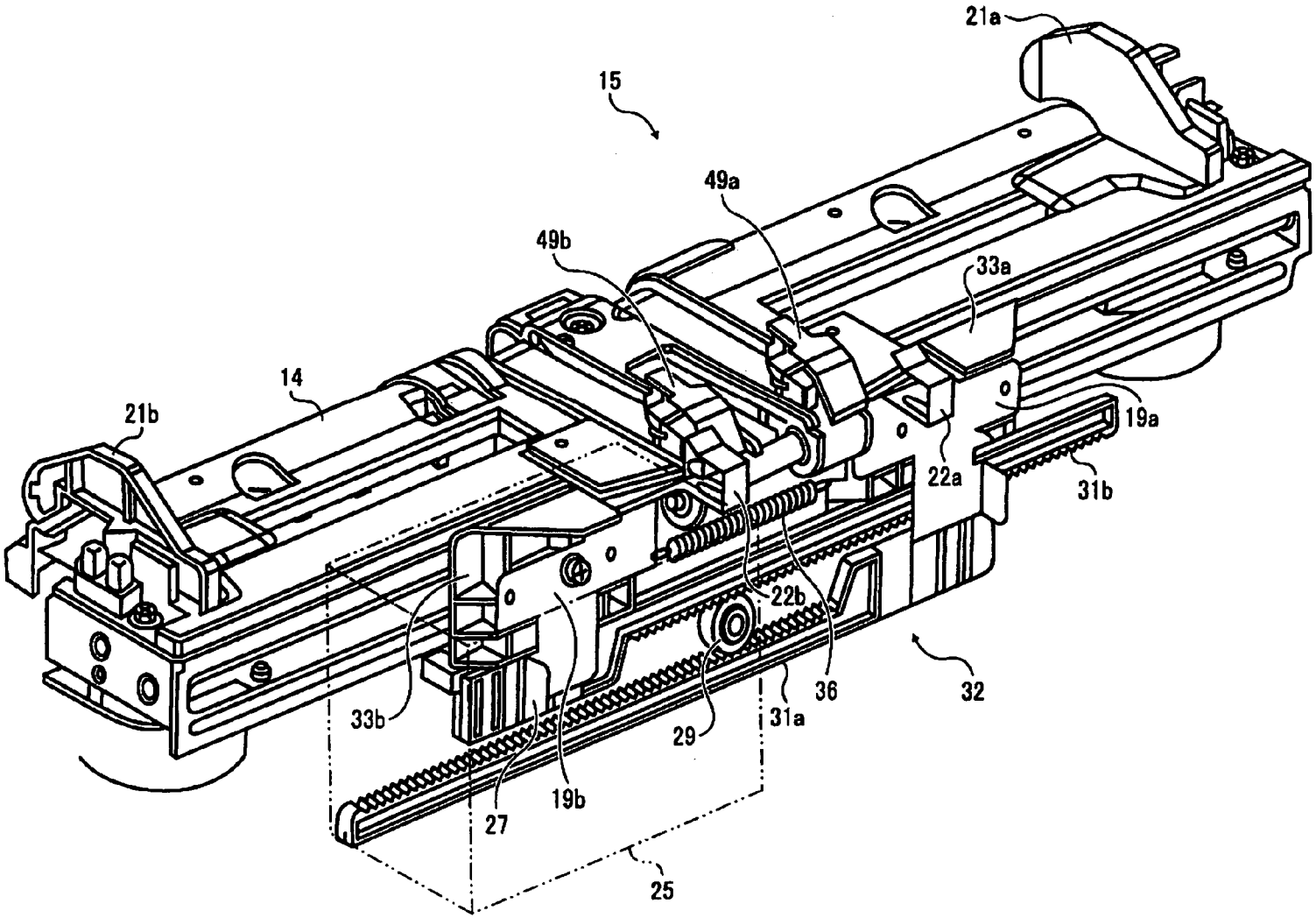
FIG. 3 is a perspective view of the relevant portion of the staple tray.
Figure 4:
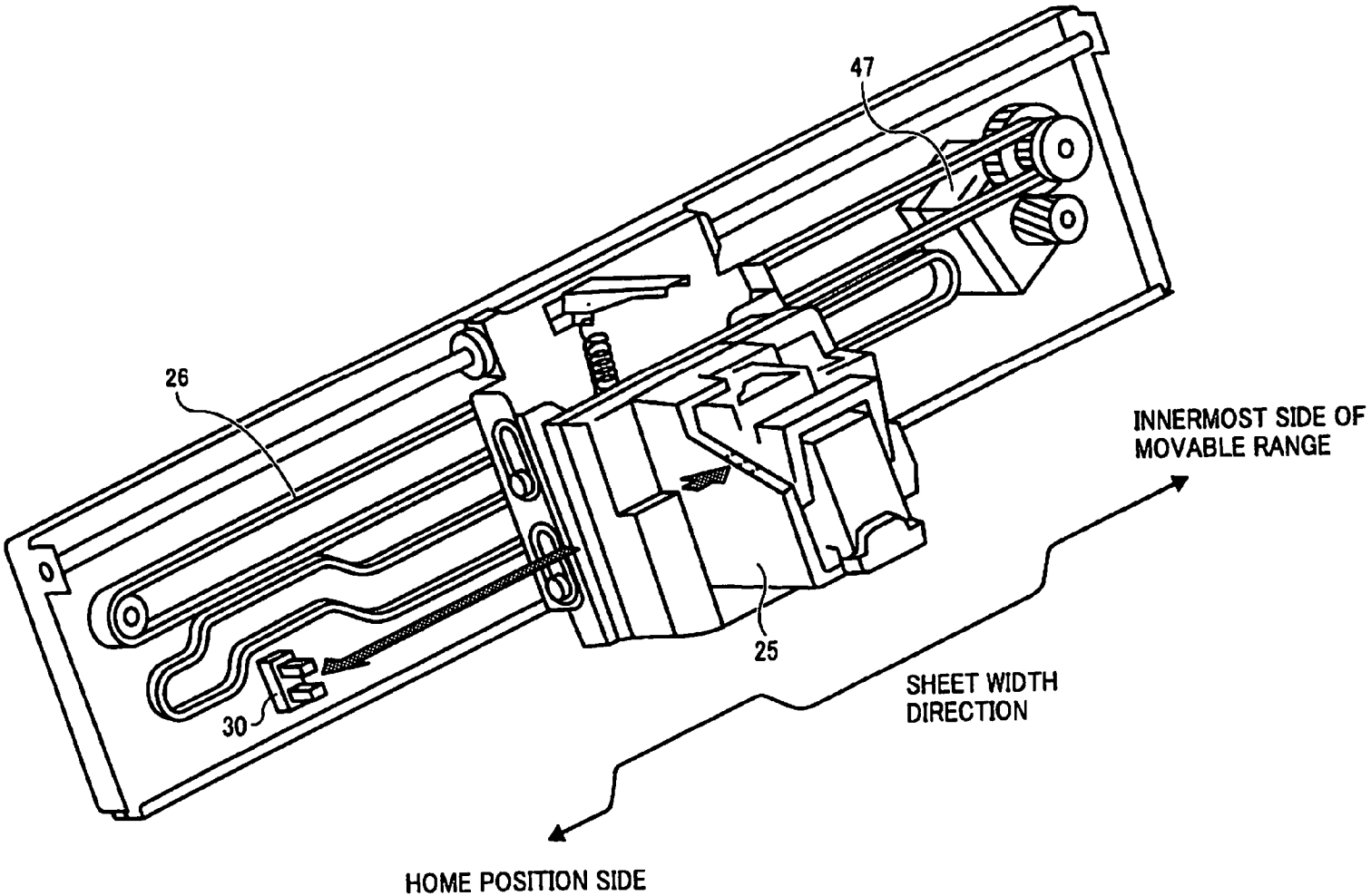
FIG. 4 is a perspective view explaining a mechanism of a stapler according to the first embodiment.
Figure 5A:
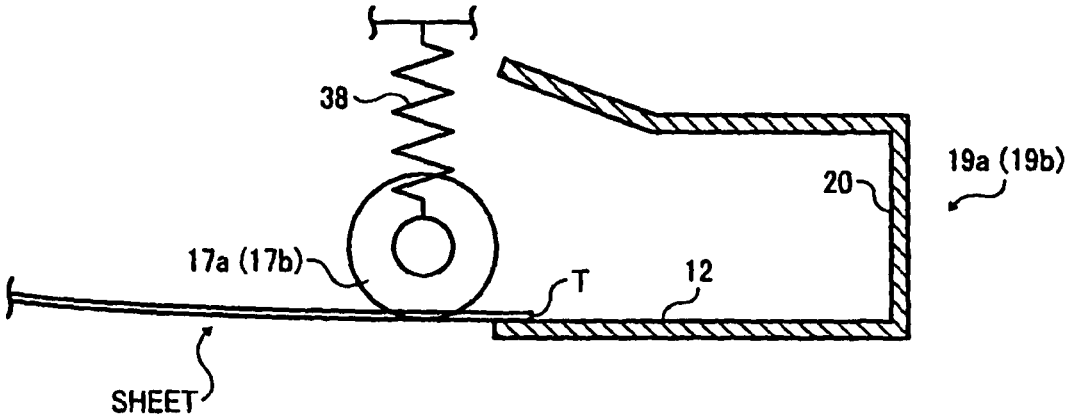
FIGS. 5A and 5B are cross sections of a relevant portion of a trailing edge fence of the sheet post-processing device in the sorting mode before aligning a trailing edge of a sheet.
Figure 5B:
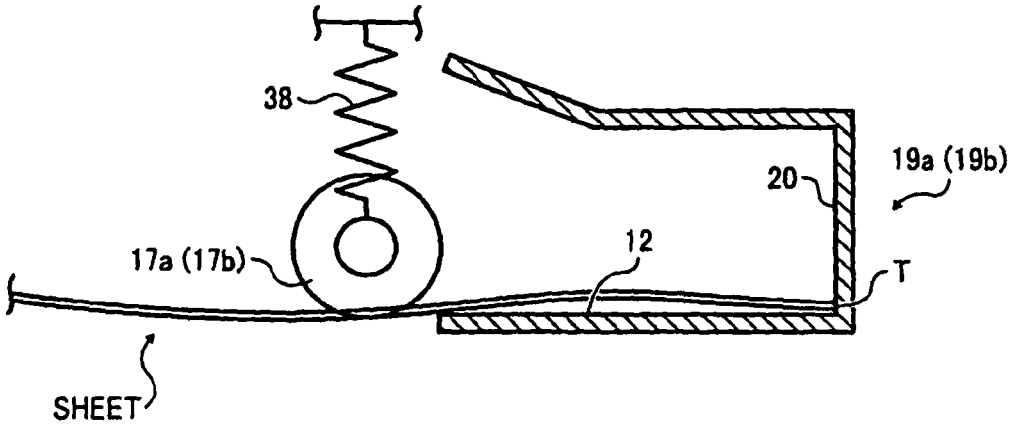
Figure 6:
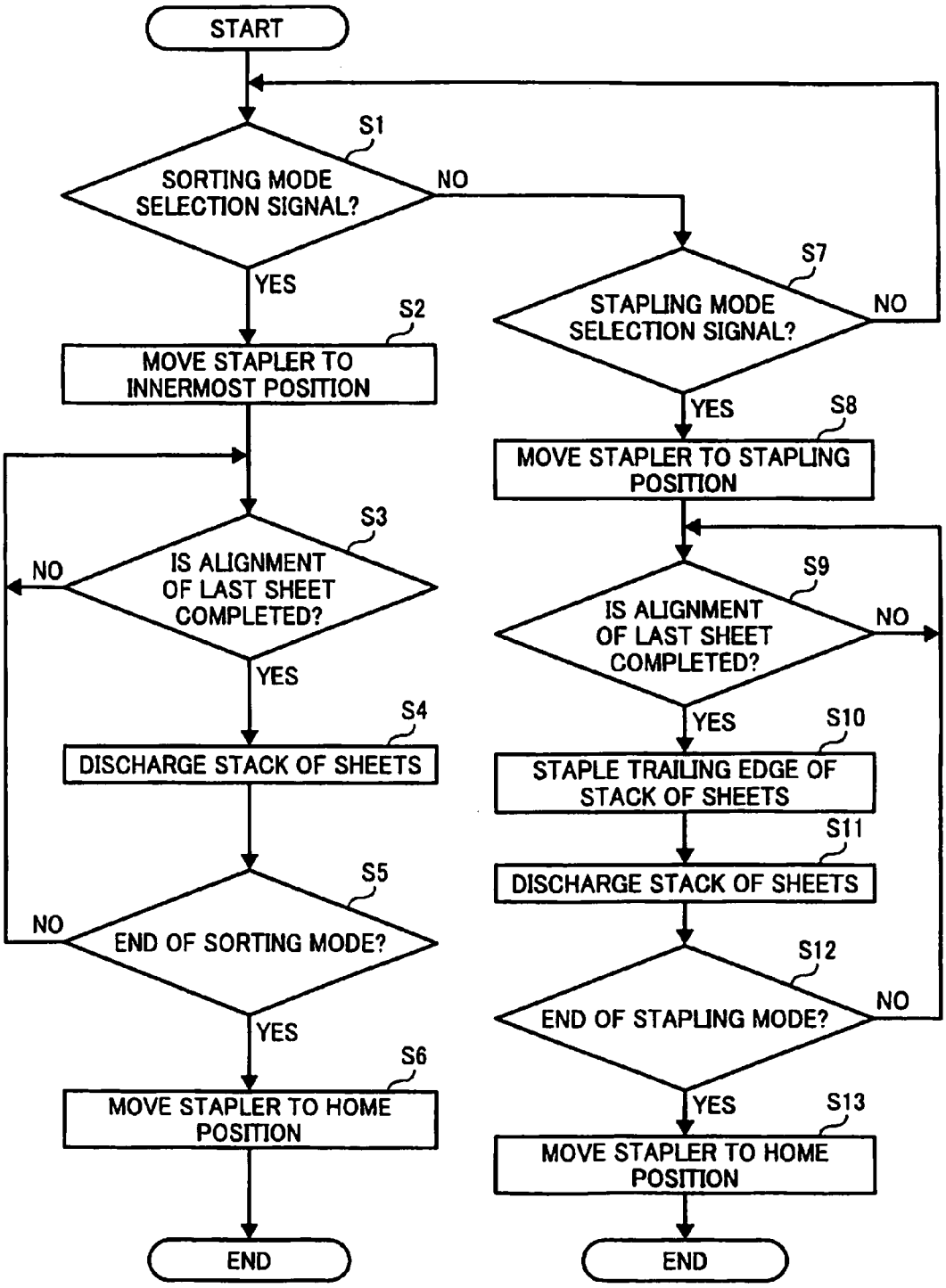
FIG. 6 is a flowchart of an operation of a sheet-edge aligning unit according to the first embodiment.
Figure 7:
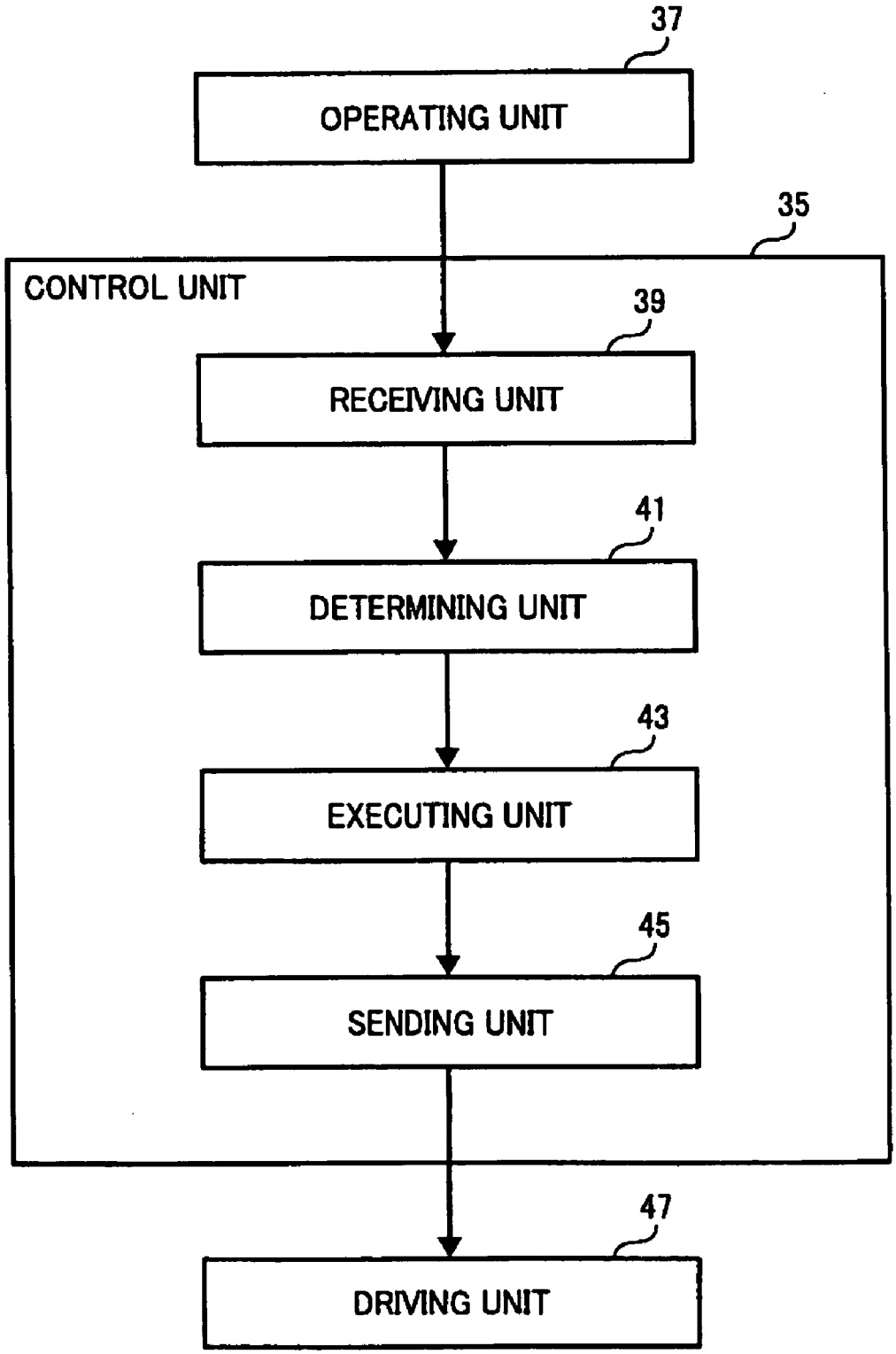
FIG. 7 is a block diagram of a control unit of an image forming apparatus according to a second embodiment of the present invention.
Figure 8:
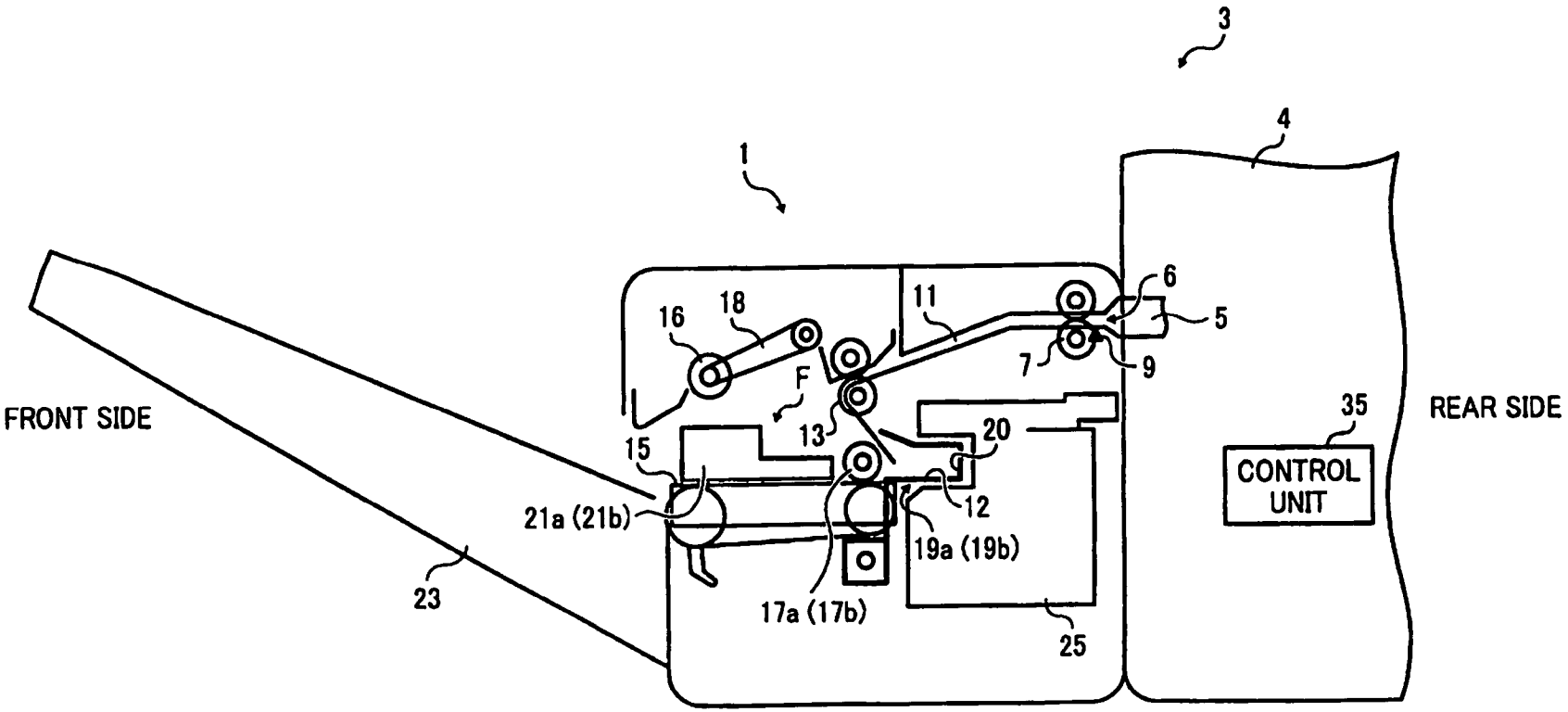
FIG. 8 is a schematic cross section of the image forming apparatus according to the second embodiment.

FIG. 1 is a plan view of a relevant portion of a staple tray 15 of a sheet post-processing device 1 in sorting mode according a first embodiment of the present invention. FIG. 2 is a plan view of the relevant portion of the staple tray 15 of the sheet post-processing device 1 in stapling mode. In FIGS. 1 and 2, a contour of an A4-size sheet is indicated by a dashed-two dotted line. FIG. 3 is a perspective view of the relevant portion of the staple tray 15. FIG. 4 is a perspective view explaining a mechanism of a stapler 25 according to the first embodiment of the present invention. FIG. 5A is a cross section of a relevant portion of a first trailing edge fence 19*a* or a second trailing edge fence 19*b* of the sheet post-processing device 1 in the sorting mode before aligning a trailing edge of a sheet. FIG. 5B is a cross section of the relevant portion of the first trailing edge fence 19*a* or the second trailing edge fence 19*b* of the sheet post-processing device 1 in the sorting mode after aligning the trailing edge of the sheet. FIG. 6 is a flowchart of an operation of a sheet-edge aligning unit F according to the first embodiment. FIG. 7 is a block diagram of a control unit 35 of an image forming apparatus 3 according to the second embodiment of the present invention. FIG. 8 is a schematic cross section of the image forming apparatus 3 according to the second embodiment.

As shown in FIG. 8, the image forming apparatus 3 includes an image-forming-apparatus main unit 4 and the sheet post-processing device 1 that performs post-processing of a recording medium (hereinafter, "sheet") on which an image is formed by the image-forming-apparatus main unit 4.

The image-forming-apparatus main unit 4 serves as a copier, and includes a image reading unit (not shown) that reads an image of an original, an image forming unit (not shown) that forms the image of the original that is read by the image reading unit onto a sheet, a sheet supplying unit (not shown) that supplies a sheet to the image forming unit, and a sheet discharge unit 5 that discharges the sheet on which the image is formed by the image forming unit to the sheet post-processing device 1.

The sheet post-processing device 1 includes the sheet-edge aligning unit F that aligns an edge of a sheet conveyed from the image-forming-apparatus main unit 4, a feed path 11 that directs the sheet to the sheet-edge aligning unit F, and a discharge tray 23 that discharges a stack of sheets after the edge of the stack of sheets is aligned by the sheet-edge aligning unit F.

Specifically, a sheet receiving inlet 6 that communicates with the sheet discharge unit 5 of the image-forming-apparatus main unit 4 is arranged on a most upstream side of the feed path 11, and an inlet sensor 9 that detects a position of a sheet is arranged downstream of the sheet receiving inlet 6. Furthermore, a pair of conveying rollers 7 is arranged near and downstream of the inlet sensor 9, and a pair of discharge rollers 13 is arranged on a most downstream side of the feed path 11.

The sheet-edge aligning unit F performs aligning a trailing edge and a side edge of a sheet that is conveyed, and performs binding a stack of sheets including stapling the trailing edge of the stack of sheets if necessary.

The sheet-edge aligning unit F includes the staple tray 15 on which a sheet directed from the feed path 11 is stacked, a knock roller 16 and return rollers 17a and 17b (the sheet-trailing-edge aligning unit F), the stapler 25 (binding unit) that binds the stack of sheets of which the trailing edge and the side edge are aligned.

As shown in FIG. 3, the staple tray 15 is a substantially long rectangular shape in a sheet width direction (in a direction perpendicular to a sheet conveying direction) with a sheet receiving surface 14 orienting upward.

The staple tray 15, as shown in FIG. 1, includes the first trailing edge fence 19*a* and the second trailing edge fence 19*b* (reference member) serving as a reference for aligning a trailing edge of a sheet, a pair of jogger fences 21*a* and 21*b* that aligns a side edge of the sheet, and a sheet discharge unit 51 that discharges a stack of sheets to the discharge tray 23.

The first and the second trailing edge fences 19*a* and 19*b* are arranged to be protruding from a trailing edge of the staple tray 15. The first and the second trailing edge fences 19*a* and 19*b* are symmetrically arranged relative to a line A-A that is a centerline (hereinafter, "center of the staple tray 15") of the staple tray 15 in the sheet width direction.

As shown in FIG. 1, the first trailing edge fence 19*a* is configured integrally with a first fence 22*a* (sheet-trailing-edge receiving unit) and a first slider 33*a* that is supported slideably in the sheet width direction. The second trailing edge fence 19*b* is configured integrally with a second fence 22*b* (sheet-trailing-edge receiving unit) and a second slider 33*b* that is supported slideably in the sheet width direction.

Each of the first and the second fences 22*a* and 22*b* is a substantially U-shape as shown in the cross sections of FIGS. 5A, 5B, and 8, and each of reference planes 20 and 20 serving as a reference for aligning a sheet-trailing-edge T is arranged on each vertical side of each U-shape of the first and the second fences 22*a* and 22*b*. Each of sheet receiving surfaces 12 and 12 that receives a surface of a sheet is arranged on a bottom side of the U-shape.

As shown in FIG. 1, an abutting portion 27 that abuts with the stapler 25 is arranged on the second slider 33*b*, and the abutting portion 27 protrudes toward a side of the stapler 25.

As shown in FIG. 3, the first slider 33*a* is fixed on a rack 31*a* and the second slider 33*b* is fixed on a rack 31*b*. The rack 31*a* and the rack 31*b* are arranged such that tooth surfaces of the rack 31*a* and the rack 31*b* face each other, and a gear 29 that is arranged between the rack 31*a* and the rack 31*b* is engaged with each of the rack 31*a* and the rack 31*b*, whereby the first slider 33*a* and the second slider 33*b* are coupled to move in an approaching direction or in a separating direction depending on a rotational direction of the gear 29.

That is, the first and the second trailing edge fences 19*a* and 19*b* are coupled to move in an approaching direction or in a separating direction in the sheet width direction by a second link mechanism 32 that includes the rack 31*a* and the rack 31*b*, and the gear 29.

The first slider 33*a* is coupled to the second slider 33*b* through a compression coil spring 36 (biasing member) such that each of the first slider 33*a* and the second slider 33*b* is biased toward the center of the staple tray 15.

The stapler 25 is movably supported on the rear side of the staple tray 15 in the sheet width direction as shown in FIGS. 1 and 4 to be driven to operate by a driving unit 47 (stepping motor) as a moving unit capable of forward and reverse rotations through a timing belt 26. A home position sensor 30 that detects a home position of the stapler 25 is arranged on one end side of a movable range of the stapler 25, and a stapling position by the stapler 25 in the sheet width direction is controlled by the control unit 35 using displacement (amount of the movement) by the stapler 25 from the home position. That is, the stapler 25 moves between the home position and the innermost position in the sheet width direction to staple the stack of sheets on a predetermined position of the trailing edge of the stack of sheets depending on the size of the sheet. In the present embodiment, the stapler 25 staples a stack of sheets on one portion of a predetermined position (position having a predetermined distance from a side edge of the stack of sheets) at the trailing edge of the stack of sheets.

As shown in FIG. 1, an abutted portion 28 that abuts with the abutting portion 27 of the second slider 33*b* protrudes toward a side of the stapler 25. The abutted portion 28 is positioned nearer the center of the staple tray 15 relative to a position of the abutting portion 27, and a tip of the abutted portion 28 positions nearer the side of the second slider 33*b* (base side of the abutting portion 27) relative to a position of a tip of the abutting portion 27. In addition, the abutting portion 27 and the abutted portion 28 are positioned on the same height. The abutting portion 27 of the second trailing edge fence 19*b*, the abutted portion 28 of the stapler 25, and the compression coil spring 36 constitute a first link mechanism 34 that moves the stapler 25 and the second trailing edge fence 19*b* together.

Namely, the abutting portion 27 of the second slider 33*b* and the abutted portion 28 of the stapler 25 substantially abut constantly each other. In such a state, there is a predetermined interval W between the second fence 22*b* and the stapler 25 along the sheet width direction.

Accordingly, if the stapler 25 moves toward one end side (home position side) of the staple tray 15 in the sheet width direction, an interval between the first and the second trailing edge fences 19*a* and 19*b* is widened. By contrast, if the stapler 25 moves toward the center of the staple tray 15, the interval between the first and the second trailing edge fences 19*a* and 19*b* is narrowed. In other words, when the stapler 25 is positioned on the innermost position of its movable range, the first and the second trailing edge fences 19*a* and 19*b* are positioned on the innermost positions of their movable range, whereas when the stapler 25 is positioned on the home position, the first and the second trailing edge fences 19*a* and 19*b* are positioned on the outermost positions of their movable range. The interval between the first and the second trailing edge fences 19*a* and 19*b* is ensured not to be narrower than a predetermined distance because a stopper (not shown) for the first and the second trailing edge fences 19*a* and 19*b* is provided near the center of the staple tray 15. While each of the first and the second trailing edge fences 19*a* and 19*b* abuts with the stopper, the first trailing edge fence 19*a* and the second trailing edge fence 19*b* do not follow the motion of the stapler 25.

As shown in FIG. 1, the jogger fences 21*a* and 21*b* are slideably supported in the staple tray 15 in the sheet width direction, and the jogger fences 21*a* and 21*b* are spaced apart from each other in the sheet width direction. The jogger fences 21*a* and 21*b* are driven to make a linear reciprocating motion by forwarding or reversing rotational driving force by the driving unit 47. The jogger fence 21*a* or 21*b* can be independently driven.

The sheet discharge unit 51 includes a pair of delivery claws 49*a* and 49*b* that brings the stack of sheets, of which the trailing edge and the side edge is aligned, to be discharged and a pair of delivery belts (not shown) on which the delivery claws 49*a* and 49*b* are respectively mounted. Each of the delivery belts is supported with a driving roller and a driven roller, and the driving roller is driven by a motor through a driving shaft and a pulley (all are not shown). A circumferential velocity of the deriving roller is set to be faster than that of the delivery belt.

As shown in FIG. 8, the knock roller 16 is rotatably pivoted on one end of an arm 18, where another end of the arm 18 is pivoted on a position opposing the staple tray 15 to be slideable. The arm 18 is in a state to be constantly subjected to a load by self weight of the arm 18 toward a direction of the staple tray 15, and the arm 18 is retained by a lever (not shown). With such a construction, reciprocating motion by the lever brings the arm 18 to rotate toward of the staple tray 15, so that the knock roller 16 abuts with the sheet on the staple tray 15, whereby the sheet-trailing-edge T is brought into contact with the reference planes 20 and 20 of the first and the second fences 22*a* and 22*b*. Thereafter, the arm 18 rotates reversely to be retained by the lever again.

The return rollers 17*a* and 17*b* are, as shown in FIG. 1, arranged on the trailing edge of the staple tray 15 to be symmetrically positioned relative to the center of the staple tray 15. The return rollers 17*a* and 17*b* are driven to rotate by the driving unit 47. The return roller 17*a* is located opposing the first trailing edge fence 19*a* that is located on the innermost position of its movable range, and the return roller 17*b* is located opposing to the second trailing edge fence 19*b* that is located on the innermost position of its movable range. As shown in FIGS. 5 and 8, each of the return rollers 17*a* and 17*b* is biased toward the side of the staple tray 15 by a compression coil spring 38 (biasing unit), whereby each of the return rollers 17*a* and 17*b* is rotatable in a state that each outer circumference of the return rollers 17*a* and 17*b* is constantly in pressure contact with the staple tray 15 or the sheet. As shown in FIGS. 5A and 5B, each of the return rollers 17*a* and 17*b* is located near corresponding one of the first and the second trailing edge fences 19*a* and 19*b* in the sheet conveying direction. Each of the return rollers 17*a* and 17*b* is made of an elastic friction material such as a sponge.

Both ends of the discharge tray 23 are fixed in a support member, and the support member is coupled to the driving shaft through a timing belt and the pulley. The driving shaft is engaged with a gear to be coupled to a DC motor through the gear. The rotation of the DC motor causes the discharge tray 23 to make ascending motion or descending motion. The ascending motion or the descending motion by the discharge tray 23 is controlled such that the top surface of an uppermost sheet of stacked sheets or the top surface of the discharge tray 23 is detectable by a top-detecting sensor (not shown) that is arranged on a predetermined position.

The control unit 35 is arranged in the image-forming-apparatus main unit 4. As shown in FIG. 7, the control unit 35 includes a receiving unit 39 that receives an operation signal from an operating unit 37 of the image-forming-apparatus main unit 4, a determining unit 41 that determines the state based on data from the receiving unit 39, an executing unit 43 that executes processing in accordance with a determination by the determining unit 41, and a sending unit 45 that sends an executing command by the executing unit 43 to the driving unit 47.

The operation of the image forming apparatus 3 according to the present embodiment is explained below. Upon receiving a signal indicative of supplying a sheet from the operating unit 37 of the image-forming-apparatus main unit 4, a sheet is supplied to the image forming unit from a sheet supply unit. Subsequently, an image of an original that is read by an image reading unit is formed on the sheet.

The sheet feeding procedure is explained with reference to FIG. 8. The sheet on which the image is formed is discharged out of the sheet discharge unit 5 to the sheet post-processing device 1. More specifically, the sheet delivered from the sheet receiving inlet 6 is conveyed into the feed path 11 by the conveying rollers 7 to be discharged to the staple tray 15 by the discharge rollers 13. The sheet discharged onto the staple tray 15 is conveyed between the sheet receiving surfaces 12 and 12 of the first and the second fences 22*a* and 22*b* and the return rollers 17*a* and 17*b* by the knock roller 16 and the return rollers 17*a* and 17*b* to be sequentially stacked on the first and the second fences 22*a* and 22*b*. At this time, the sheet-trailing-edge T (sheet conveying direction) of each sheet is aligned by the knock roller 16 and the return rollers 17*a* and 17*b*, and the side edge U of the sheet (sheet width direction) is aligned by the jogger fences 21*a* and 21*b*.

The degree of curling of the sheet-trailing-edge T increases from the center to the side edge U in the sheet width direction. As shown in FIG. 1, in the present embodiment, when the first and the second fences 22*a* and 22*b* are positioned on the innermost positions of their movable range in sorting mode as shown in FIG. 1, the interval between the first and the second fences 22*a* and 22*b* shown by the arrow M in FIG. 1 is set to 104 millimeters. In this case, the positions of the first and the second fences 22*a* and 22*b* are largely away from the side edges of the sheet-trailing-edge T, so that the sheet-trailing-edge T can abut with the reference planes 20 and 20 in a state that the sheet-trailing-edge T is hardly susceptible to the effect by the curling of the side edge of the sheet-trailing-edge T. Furthermore, as shown in FIGS. 5A and 5B, the return rollers 17*a* and 17*b* are positioned substantially on the same position as (opposed position to) the positions of the first and the second fences 22*a* and 22*b* that are positioned on the innermost positions of their movable range in the sheet width direction. Accordingly, by nipping a curled portion of the center of the sheet-trailing-edge T in the sheet width direction between the return rollers 17*a* and 17*b* and the sheet receiving surfaces 12 and 12 of the first and the second fences 22*a* and 22*b*, the sheet-trailing-edge T can be surely abutted with the reference planes 20 and 20 by further preventing susceptibility to the effect by the curling of the sheet-trailing-edge T. The positions of the first and the second fences 22*a* and 22*b* in the sorting mode are on the innermost positions of their movable range in a state that each of the first and the second fences 22*a* and 22*b* abuts with the stopper that is located near the center of the staple tray 15. The stapler 25 is positioned nearer the home position in relation to the center of the staple tray 15, so that a slight gap is ensured from the abutted portion 28 of the stapler 25 and from the abutting portion 27 of the second slider 33*b*.

Operation in the sorting mode from aligning the side edge of the sheet to discharging the stack of sheets is explained. Each of the jogger fences 21*a* and 21*b* moves to a receiving position corresponding to the width of the sheet to be conveyed upon receiving a signal indicative of discharging a sheet that is output from the control unit 35 of the image-forming-apparatus main unit 4. Each of the jogger fences 21*a* and 21*b* moves to the position having a dimension of the width of the sheet plus seven millimeters and stops. This position is the position to receive the sheet. Upon starting of the rotation of the knock roller 16 after the sheet-trailing-edge T passes through the discharge rollers 13, each of the jogger fences 21*a* and 21*b* moves forward by five millimeters to the position having a dimension of the width of the sheet plus two millimeters and then stops. Furthermore, when the sheet-trailing-edge T is brought to be abutted with the reference planes 20 and 20 of the first and the second fences 22*a* and 22*b* by the knock roller 16 and the return rollers 17*a* and 17*b*, concurrently, each of the jogger fences 21*a* and 21*b* moves forward by two millimeters, so that the sheet is aligned toward the center of the sheet. Then, the jogger fences 21*a* and 21*b* move backward to the receiving positions again and stop to wait for the next sheet to be discharged. This operation is repeated for sequentially discharged sheets, so that a stack of sheets is aligned toward the center. After the side U of the stack of sheets is aligned, the jogger fences 21*a* and 21*b* together with the stack of sheets are moved by 15 millimeters toward a side of the jogger fence 21*a*, so that the stack of sheets is offset by 15 millimeters from the center and the stack of sheets is discharged to the discharge tray 23 by the sheet discharge unit 51. For the next aligned stack of sheets, by changing the offsetting direction of the jogger fences 21*a* and 21*b* to a side of the jogger fence 21*b*, the next stack of sheets is offset in the opposite direction from the offsetting direction for the previous stack of sheets. The offsetting is repeatedly performed for predetermined sets of the stack of sheets, so that the stack of sheets are alternatively shifted to be stacked on the discharge tray 23. In this manner, sorting of the stack of sheets is performed. The timing for operating the jogger fences 21*a* and 21*b* is all controlled using time control from the moment that the inlet sensor 9 detects passing of the sheet-trailing-edge T.

The stapling process of the sheet-trailing-edge T in stapling mode is explained. Aligning the sheet-trailing-edge T is performed in the same manner as in the sorting mode. When aligning of the predetermined number of the sheets is completed, the stack of sheets on the predetermined position in the trailing edge is stapled by the stapler 25 and is discharged onto the discharge tray 23 by the sheet discharge unit 51. In this case also, the timing for operating the jogger fences 21*a* and 21*b* is all controlled using time control from the moment that the inlet sensor 9 detects passing of the sheet-trailing-edge T. As shown in FIG. 2, when the sheet size is A4, an interval (indicated by an arrow L in FIG. 2) between the first and the second fences 22*a* and 22*b* is set to 209 millimeters. In the present embodiment, when stapling the stack of sheets on one portion, the stapler 25 is moved to staple a position of the stack of sheets having a predetermined distance from the side of the trailing edge of the stack of sheets regardless of the size of the sheet. Accordingly, the distance from the side of the stack of sheets to each of the first and the second fences 22*a* and 22*b* is kept constant regardless of the size of the sheet.

The controlling process of the sheet-edge aligning unit F is explained with reference to FIG. 6. The determining unit 41 determines whether the receiving unit 39 receives a signal indicative of sorting mode selection from the operating unit 37 of the image-forming-apparatus main unit 4 (Step S1). When the determining unit 41 determines that the receiving unit 39 receives the signal indicative of sorting mode selection, the executing unit 43 brings the stapler 25 to move to the innermost position (position shown in FIG. 1) of its movable range (Step S2). Accordingly, the first and the second trailing edge fences 19*a* and 19*b* move to the innermost positions of their movable range. At this moment, the determining unit 41 determines whether the trailing edge and the side edge of the last sheet are aligned on the staple tray 15 (Step S3). If the determining unit 41 determines the trailing edge or the side edge of the last sheet is not aligned, the determining unit 41 repeats the same determining process. When the determining unit 41 determines the trailing edge and the side edge of the last sheet are aligned, the executing unit 43 brings the stack of sheets to be discharged (Step S4). Then, the determining unit 41 determines whether the sorting mode is completed (Step S5). When the determining unit 41 determines the sorting mode is completed, the executing unit 43 brings the stapler 25 to move to the home position (Step S6) to complete the stapling process. Accordingly, the first and the second trailing edge fences 19*a* and 19*b* return to the home positions. If the determining unit 41 determines that the sorting mode is not completed, the system control returns to Step S3. By contrast, if the determining unit 41 determines that the receiving unit 39 does not receive the signal indicative of sorting mode selection (No at Step S1), subsequently, the determining unit 41 determines whether the receiving unit 39 receives a signal indicative of stapling mode selection from the operating unit 37 of the image-forming-apparatus main unit 4 (Step S7). If the determining unit 41 determines that the receiving unit 39 does not receive the signal indicative of stapling mode selection, the determining unit 41 repeats the same determining process. When the determining unit 41 determines that the receiving unit 39 receives the signal indicative of stapling mode selection, the executing unit 43 brings the stapler 25 to a stapling position (position shown in FIG. 2) (Step S8). At this step, the determining unit 41 determines whether the trailing edge and the side edge of the last sheet are aligned on the staple tray 15 (Step S9). If the determining unit 41 determines the trailing edge or the side edge of the last sheet is not aligned, the determining unit 41 repeats the same determining process. When the determining unit 41 determines the trailing edge and the side edge of the last sheet are aligned, the executing unit 43 brings the stapler 25 to staple the trailing edge of the stack of sheets (Step S10) to subsequently bring the stack of sheets to be discharged (Step S11). At this step, the determining unit 41 determines whether the stapling mode is completed (Step S12). When the determining unit 41 determines that the stapling mode is completed, the executing unit 43 brings the stapler 25 to the home position (Step S13)

to complete the stapling process. If the determining unit 41 determines that the stapling mode is not completed, the system control returns to step S9.

According to the embodiment, when aligning the trailing edge of the sheet, because the first trailing edge fence and the second rear fence are positioned toward the center, the trailing edge of the sheet can be abutted with the reference planes of the first and the second trailing edge fences even if the side edge of the sheet is curled. As a result, when discharging an unstapled stack of sheets, insufficient alignment of the trailing edge of the stack of sheets and disorder of the sheets are preventable, allowing sorting of stack of sheets.

Furthermore, according to the embodiment, with the use of the link mechanism, the second trailing edge fence and the stapler operate in a coupled manner, so that mounting an exclusive driving unit for moving the second trailing edge fence is not needed, leading to downsizing and cost reduction of the sheet post-processing device.

Moreover, according to the embodiment, the second trailing edge fence does not disturb the stapling operation by the stapler by the coupling operation of the second trailing edge fence and the stapler keeping the predetermined distance between the second trailing edge fence and the stapler in the sheet width direction.

Furthermore, according to the embodiment, the second trailing edge fence and the stapler can be operated in a coupled manner with the simple structure of the abutting portion that protrudes from the second trailing edge fence, the abutting portion that protrudes from the stapler, and the coil spring that biases the second trailing edge fence.

Moreover, according to the embodiment, the first trailing edge fence and the second trailing edge fence are coupled to move in the approaching direction or in the separating direction, whereby the first and the second trailing edge fences are movable between the home positions and the innermost positions of their movable range by moving the stapler for the displacement by the second trailing edge fence between the home position and the innermost position of its movable range. This leads to reduction of the displacement by the stapler to move the first and the second trailing edge fences, resulting in energy saving.

Furthermore, according to the embodiment, when the trailing edge of the sheet is aligned and the stack of sheets is unstapled to be discharged, because of the positions of the first and second trailing edge fences that oppose the return rollers, nipping the slightly curled portion of the center of the trailing edge of the sheet in the sheet width direction by the return rollers and the receiving surfaces of the trailing edge fences allows to surely prevent insufficient alignment of the trailing edge of the sheet.

Moreover, according to the embodiment, the return rollers are constantly biased toward the side of the staple tray by the compression coil spring (biasing unit), so that the sheet can be conveyed to the trailing edge fences in the state that the slightly curled portion of the center of the trailing edge of the sheet in the sheet width direction is being pressed against the staple tray. As a result, the trailing edge of the sheet can be surely abutted with the reference planes.

Furthermore, according to the embodiment, the trailing edge fences are arranged symmetrically relative to the center of the staple tray, so that the trailing edge fences can receive the sheet in a well-balanced manner, leading to prevention of insufficient alignment of the trailing edge of the sheet.

In lieu of the present invention, it is possible to provide an image forming apparatus that includes a sheet post-processing device that brings about the same advantageous effect as those mentioned above and a control unit that controls the movement of trailing edge fences.

It is not intended to limit the invention to the precise form disclosed. Many modifications and variations may be made therein without departing from the scope of the invention.

As stated above, the second trailing edge fence is abutted with the stapler to move the first and second trailing edge fences by a driving force of the stapler. However, the construction is not limited thereto. A driving unit exclusive for the first and the second trailing edge fences can be arranged in addition to the driving unit for the stapler to independently move the first and the second trailing edge fences from the stapler, eliminating the abutting of the second trailing edge fence with the stapler. In this case, the driving unit exclusive for the first and the second trailing edge fences can be coupled to a gear of the second link mechanism to drive the gear.

The first trailing edge fence and the second trailing edge fence are coupled via the compression coil spring in the above embodiments; however the present invention is not limited thereto. It is possible that, at least, one of the first and the second trailing edge fences is biased toward the center side of the staple tray.

In lieu of the positioning that the first and the second trailing edge fences are biased toward the center side of the staple tray, and the abutted portion of the stapler is positioned nearer the center of the staple tray relative to the position of the abutting portion of the second trailing edge fence as stated in the above embodiments, each of the first and the second trailing edge fences can be biased outwardly in the sheet width direction of the staple tray by the coil spring and the abutting portion of the second trailing edge fence can be positioned nearer the center of the staple tray relative to the position of the abutted portion of the stapler. In such a case, at least, one of the first and the second trailing edge fences can be biased outwardly in the sheet width direction of the staple tray by the coil spring.

Alternatively for the second link mechanism that includes a pair of the racks and the gear as stated in the above embodiments, the center portion of the link mechanism can be pivoted to be rotatable. In addition, one end of the link mechanism can be fixed with the first trailing edge fence and another end of the link mechanism can be fixed with the second trailing edge fence to couple the operations of the first and the second trailing edge fences.

Although the control unit is arranged in the image-forming-apparatus main unit 4 in the above embodiments; however, alternatively, the control unit can be arranged in the sheet post-processing device.

The image-forming-apparatus main unit 4 is exemplified as the copier that includes the imager reading unit in the above embodiments; however, the present invention is not limitedly applied thereto. Alternatively, the image forming apparatus can be, for example, a printer that does not include the image reading unit.

As described above, according to one aspect of the present invention, in the case in which a stack of sheets are not bound, because the reference planes of the trailing edge are positioned toward the center when aligning the trailing edge of the sheet, the trailing edge of the sheet can be abutted with the reference planes even if the side edge of the sheet is curled. As a result, when discharging an unstapled stack of sheets, insufficient alignment of the trailing edge of the stack of sheets and disorder of the sheets are preventable, allowing sorting of stack of sheets.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet post-processing device that discharges a stack of sheets with trailing edges aligned with performing a binding process or without performing the binding process, the sheet post-processing device comprising:

a binding tray on which the sheets are stacked;

a reference member that serves as a reference for aligning the trailing edges of the sheets stacked on the binding tray;

a binding unit that binds the sheets with the trailing edges aligned;

a discharge tray to which the sheets are discharged;

a discharge unit that discharges the sheets with or without performing the binding process from the binding tray to the discharge tray;

a moving unit that moves the reference member in a sheet width direction; and a control unit that controls the moving unit, wherein the control unit controls the moving unit to move the reference member in a sheet width direction such that a first position of the reference member at a time of discharging the sheets without performing the binding process is closer to a center of the binding tray than a second position of the reference member at a time of discharging the sheets with performing the binding process.

2. The sheet post-processing device according to claim 1, further comprising:

a driving unit that drives the binding unit to move; and a link mechanism that couples the binding unit and the reference member, wherein the reference member includes a receiving unit that receives the trailing edges of the sheets, and the link mechanism moves the binding unit and the reference member together keeping a predetermined interval between the binding unit and the receiving unit in the sheet width direction.

3. The sheet post-processing device according to claim 2, wherein the link mechanism includes a biasing member that biases the reference member toward the center of the binding tray in the sheet width direction, an abutting portion that protrudes from the reference member and abuts with the binding unit, and an abutted portion that protrudes from the binding unit, and the abutted portion is closer to the center of the binding tray than the abutting portion in the sheet width direction.

4. The sheet post-processing device according to claim 1, wherein the reference member includes a first reference member and a second reference member arranged on a first position and a second position, respectively, across the center of the binding tray in the sheet width direction, the sheet post-processing device further comprises a link mechanism that couples the first reference member and the second reference member, and the link mechanism moves the first reference member and the second reference member together in an approaching direction or in a separating direction from each other.

5. The sheet post-processing device according to claim 4, wherein the first reference member and the second reference member are arranged symmetrically relative to the center of the binding tray in the sheet width direction.

6. The sheet post-processing device according to claim 1, further comprising an aligning member that brings the trailing edges of the sheets to abut with the reference member for aligning the trailing edges of the sheets, wherein the aligning member is positioned opposing the reference member at the time of discharging the sheets without performing the binding process and aligning the trailing edges of the sheets, so that the sheets are directed between the aligning member and the reference member.

7. The sheet post-processing device according to claim 5, wherein the aligning member is a return roller that returns the sheets conveyed onto the binding tray to the reference member side, and the sheet post-processing device further comprises a biasing unit that biases the return roller toward the binding tray side.

8. The sheet post-processing device according to claim 1, wherein the reference member includes a first reference member and a second reference member arranged on a first position and a second position, respectively, across the center of the binding tray in the sheet width direction, the first reference member is configured integrally with a first sheet trailing edge receiving unit and a first slider that is supported slidably in the sheet width direction; and the second reference member is configured integrally with a second sheet trailing edge receiving unit and a second slider that is supported slidably in the sheet width direction.

9. The sheet post-processing device according to claim 8, wherein the first and sheet trailing edge receiving units protrude from the first and second reference members, respectively.

10. The sheet post-processing device according to claim 8, wherein the first and sheet trailing edge receiving units are substantially U-shaped.

11. The sheet post-processing device according to claim 8, wherein the first slider is fixed on a first rack and the second slider is fixed on a second rack.

12. The sheet post-processing device according to claim 11, wherein the first rack and the second rack are arranged such that tooth surfaces of the first and second racks face each other, and a gear that is arranged between the first rack and the second rack so that the gear is engaged with each of the first rack and the second rack, wherein the first slider and the second slider are coupled to move in an approaching direction or in a separating direction depending on a rotational direction of the gear.

13. The sheet post-processing device according to claim 11, wherein the first slider is coupled to the second slider through a biasing member such that each of the first slider and the second slider is biased toward the center of the staple tray.

14. The sheet post-processing device according to claim 1, further comprising a pair of jogger fences that aligns a side edge of the sheet.

15. The sheet post-processing device according to claim 14, wherein the pair of jogger fences are slidably supported in the staple tray in the sheet width direction, and spaced apart from each other in the sheet width direction.

16. The sheet post-processing device according to claim 14, wherein the pair of jogger fences are driven to make a linear reciprocating motion by a forward or reverse rotational driving force by a driving unit.

17. The sheet post-processing device according to claim 1, wherein the discharge unit further includes a pair of delivery claws that brings the stack of sheets, of which the trailing edge and the side edge is aligned, to be discharged.

18. The sheet post-processing device according to claim 1, wherein in a first mode, the binding unit is moved to an innermost position of its movable range, and in a second mode, the binding unit is moved to a staple position of its movable range.

19. An image forming apparatus comprising:

a sheet post-processing device that discharges a stack of sheets with trailing edges aligned with performing a binding process or without performing the binding process, the sheet post-processing device including a binding tray on which the sheets are stacked, a reference member that serves as a reference for aligning the trailing edges of the sheets stacked on the binding tray, a binding unit that binds the sheets with the trailing edges aligned, a discharge tray to which the sheets are discharged, and a discharge unit that discharges the sheets with or without performing the binding process from the binding tray to the discharge tray;

a moving unit that moves the reference member in a sheet width direction; and a control unit that controls the moving unit, wherein the control unit controls the moving unit to move the reference member, such that a first position of the reference member at a time of discharging the sheets without performing the binding process is closer to a center of the binding tray than a second position of the reference member at a time of discharging the sheets with performing the binding process.

* * * * *